US008755703B2

(12) United States Patent
Kinoshita et al.

(10) Patent No.: US 8,755,703 B2
(45) Date of Patent: Jun. 17, 2014

(54) IMAGE PROCESSING APPARATUS

(75) Inventors: Shinichi Kinoshita, Kanagawa (JP); Masafumi Ono, Kanagawa (JP); Kenji Kuroishi, Kanagawa (JP); Kazuo Fukawa, Kanagawa (JP); Keita Kumokiri, Kanagawa (JP); Hiroyuki Tanaka, Kanagawa (JP); Yohei Hirota, Kanagawa (JP); Sakae Okazaki, Kanagawa (JP); Hidenobu Kanda, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 140 days.

(21) Appl. No.: 13/448,888

(22) Filed: Apr. 17, 2012

(65) Prior Publication Data

US 2013/0164012 A1 Jun. 27, 2013

(30) Foreign Application Priority Data

Dec. 22, 2011 (JP) ..... 2011-281792

(51) Int. Cl.
*G03G 15/20* (2006.01)

(52) U.S. Cl.
USPC ..... 399/67; 399/43; 399/69; 399/82; 399/329

(58) Field of Classification Search
USPC ..... 399/67, 69, 82, 43, 328, 329
See application file for complete search history.

(56) References Cited

U.S. PATENT DOCUMENTS

| | | | | |
|---|---|---|---|---|
| 7,218,874 | B2 * | 5/2007 | Tomiyori et al. | 399/68 |
| 2009/0290916 | A1 | 11/2009 | Baba | |
| 2011/0299899 | A1 * | 12/2011 | Ishigaya et al. | 399/329 |
| 2012/0148317 | A1 * | 6/2012 | Samei et al. | 399/328 |

FOREIGN PATENT DOCUMENTS

| | | | |
|---|---|---|---|
| JP | 8-286549 | A | 11/1996 |
| JP | 2003-122071 | A | 4/2003 |
| JP | 2005-3818 | A | 1/2005 |
| JP | 2005-37478 | A | 2/2005 |
| JP | 2005-55788 | A | 3/2005 |
| JP | 2007-199283 | A | 8/2007 |
| JP | 2008-145815 | A | 6/2008 |
| JP | 2009-282413 | A | 12/2009 |

* cited by examiner

*Primary Examiner* — Sophia S Chen
(74) *Attorney, Agent, or Firm* — Sughrue Mion, PLLC

(57) ABSTRACT

An image processing apparatus includes an image forming section, a fixing section, a mode switching section that selectively switches a fixing mode between a fast heating mode and a heat accumulation mode, a selecting section that selects the fast heating mode or heat accumulation mode based on the relationship between operation expressions F1+P1×N and W+F2+P2×N, where N is the number of sheets to process, F1 is the time from instruction of processing in fast heating mode to processing start, P1 is the per-sheet processing time in fast heating mode, W is the warm-up time for the heat accumulation mode, F2 is the time from instruction of processing in heat accumulation mode to processing start, and P2 is the per-sheet processing time in heat accumulation mode, and a switching controller that controls the mode switching section to switch to the fast heating or heat accumulation mode based on the selected mode.

13 Claims, 10 Drawing Sheets

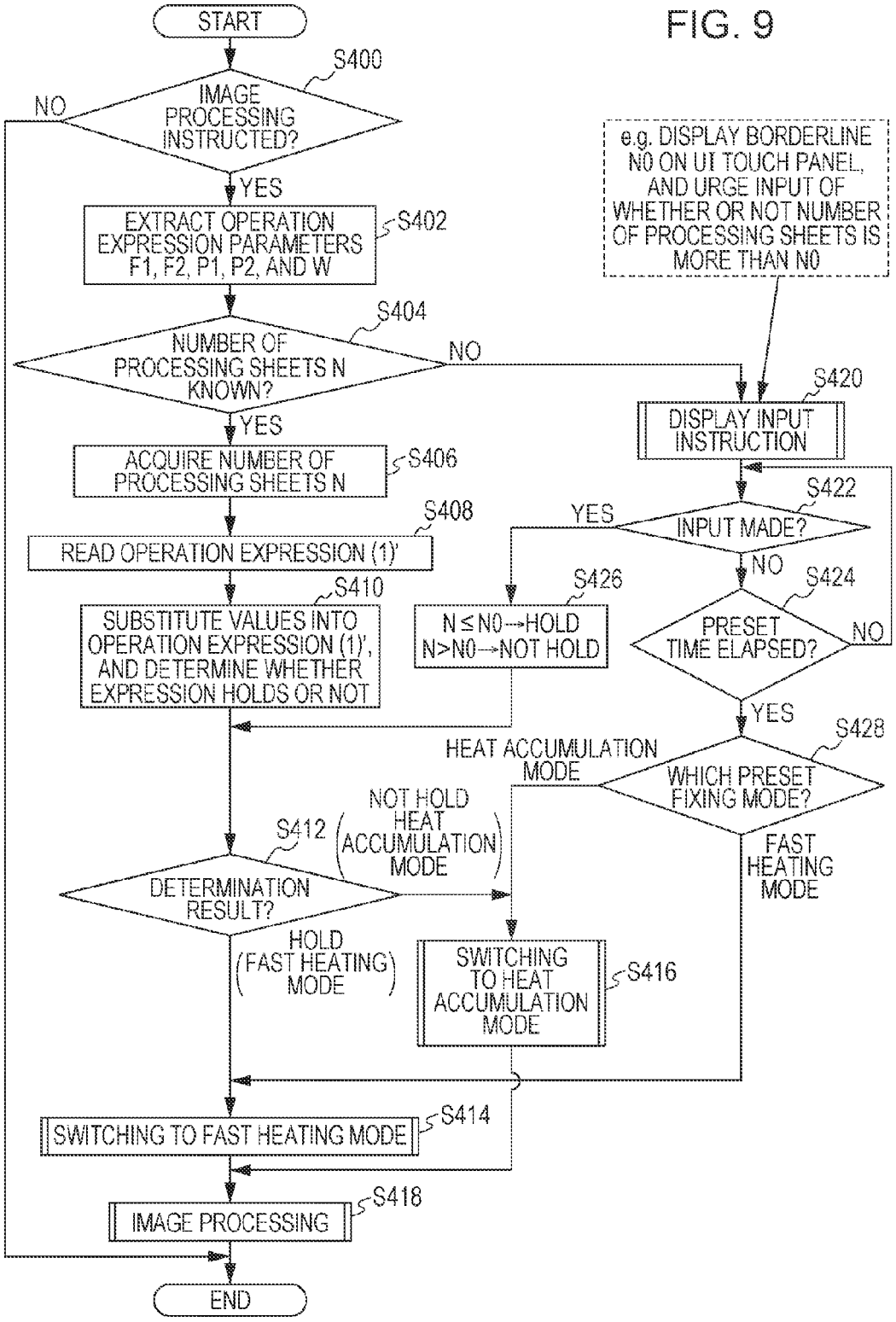
FIG. 9
START
S400
IMAGE PROCESSING INSTRUCTED?
NO
YES
EXTRACT OPERATION EXPRESSION PARAMETERS F1, F2, P1, P2, AND W
S402
S404
NUMBER OF PROCESSING SHEETS N KNOWN?
NO
YES
ACQUIRE NUMBER OF PROCESSING SHEETS N
S406
S408
READ OPERATION EXPRESSION (1)'
S410
SUBSTITUTE VALUES INTO OPERATION EXPRESSION (1)', AND DETERMINE WHETHER EXPRESSION HOLDS OR NOT
S412
DETERMINATION RESULT?
NOT HOLD HEAT ACCUMULATION MODE
HOLD (FAST HEATING MODE)
SWITCHING TO HEAT ACCUMULATION MODE
S416
SWITCHING TO FAST HEATING MODE
S414
IMAGE PROCESSING
S418
END
e.g. DISPLAY BORDERLINE N0 ON UI TOUCH PANEL, AND URGE INPUT OF WHETHER OR NOT NUMBER OF PROCESSING SHEETS IS MORE THAN N0
S420
DISPLAY INPUT INSTRUCTION
S422
INPUT MADE?
YES
NO
S426
N ≤ N0→HOLD
N>N0→NOT HOLD
S424
PRESET TIME ELAPSED?
NO
YES
S428
WHICH PRESET FIXING MODE?
HEAT ACCUMULATION MODE
FAST HEATING MODE

IMAGE PROCESSING APPARATUS

CROSS-REFERENCE TO RELATED APPLICATIONS

This application is based on and claims priority under 35 USC 119 from Japanese Patent Application No. 2011-281792 filed Dec. 22, 2011.

BACKGROUND

(i) Technical Field

The present invention relates to an image processing apparatus.

SUMMARY

According to an aspect of the invention, there is provided an image processing apparatus including an image forming section, a fixing section that fixes a developer onto a recording paper by applying at least heat treatment, after a developing process using the developer is performed on the recording paper, the fixing section including a fixing member that contacts the recording paper, and a heat accumulating member, a mode switching section that functions as a part of the image forming section, and selectively switches a fixing mode that heats the fixing member in advance, the fixing mode including a fast heating mode that relatively focuses on rapid raising of a temperature, and a heat accumulation mode that relatively focuses on heat accumulation in the heat accumulating member in advance for high productivity, a selecting section that selects one of the fast heating mode and the heat accumulation mode as the fixing mode on a basis of a relationship between operation expressions $F1+P1\times N$ and $W+F2+P2\times N$, where N is a number of processing sheets that is a number of sheets to be processed in image processing, F1 is a time from instruction of the image processing in the fast heating mode until the image processing on a first sheet of the recording paper is started, P1 is an image processing time per sheet of the recording paper in the fast heating mode, W is a warm-up time for the heat accumulation mode based on an initial value including a temperature of the heat accumulating member, F2 is a time from instruction of the image processing in the heat accumulation mode until the image processing on the first sheet of the recording paper is started, and P2 is an image processing time per sheet of the recording paper in the heat accumulation mode, and a switching controller that controls the mode switching section to switch to one of the fast heating mode and the heat accumulation mode on a basis of the fixing mode selected by the selecting section.

BRIEF DESCRIPTION OF THE DRAWINGS

An exemplary embodiment of the present invention will be described in detail based on the following figures, wherein:

FIGS. 7A to 7D illustrate the fixing device according to the exemplary embodiment, of which FIG. 7A is a partial cross-sectional view illustrating the separated state of the contact and separation mechanism, FIG. 7B is a front view illustrating the separated state of a temperature-sensitive magnetic member, FIG. 7C is a partial cross-sectional illustrating the contact state of the contact and separation mechanism, and FIG. 7D is a front view illustrating the contact state of the temperature-sensitive magnetic member;

FIG. 9 is a control flow chart focusing on the steps until the fixing mode of the fixing device is determined in the control of image processing in the image processing apparatus according to the exemplary embodiment.

DETAILED DESCRIPTION

Figure 1A:
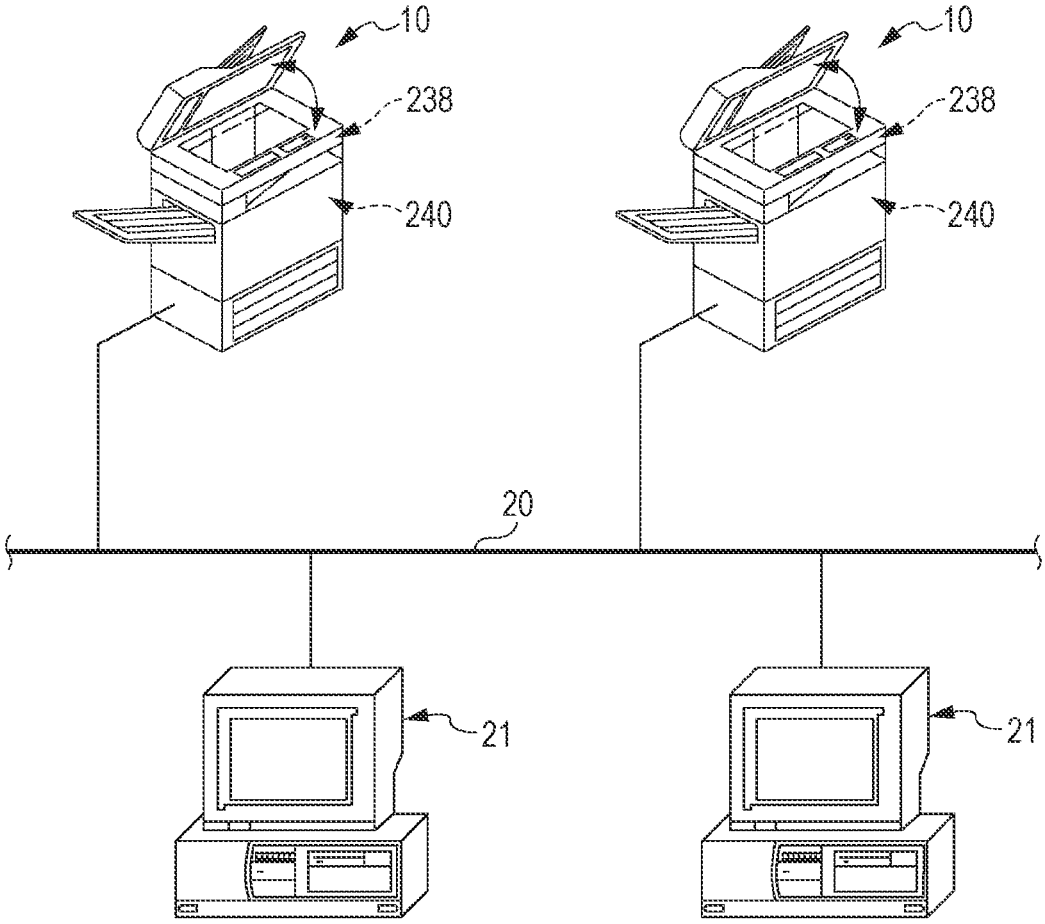
FIGS. 1A and 1B are each a connection diagram of a communications network including an image processing apparatus according to the exemplary embodiment.

As illustrated in FIG. 1A, each of image processing apparatuses 10 according to the exemplary embodiment is connected to a communications network 20 such as the Internet. While two image processing apparatuses 10 are connected in FIG. 1A, the number of the image processing apparatuses 10 connected is not particularly limited but may be one, or three or more.

Multiple personal computers (PCs) 21 as information terminal equipment are connected to the communications network 20.

Figure 1B:
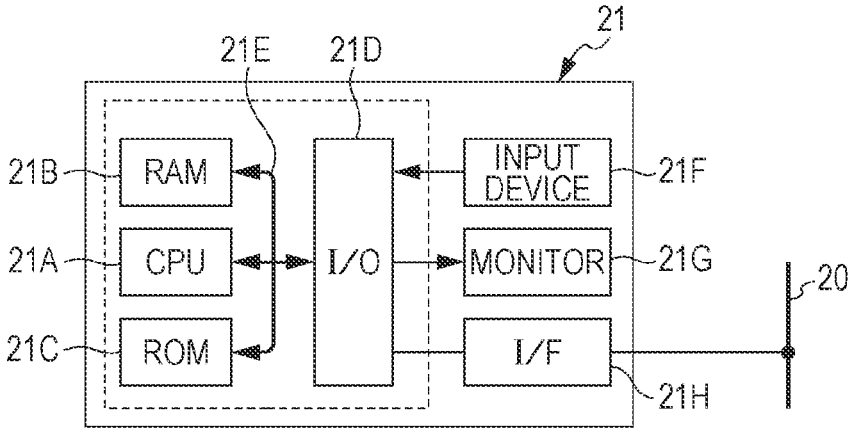

As illustrated in FIG. 1B, the PC 21 includes a CPU 21A, a RAM 21B, a ROM 21C, an I/O 21D, and a bus 21E such as a data bus or control bus that interconnects these components.

The I/O 21D is connected with an input device 21F such as a keyboard or a mouse, and a monitor 21G. The I/O 21D is connected to the communications network 20 via an I/F 21H.

While two PCs 21 are connected in FIG. 1A, the number of the PCs 21 connected is not particularly limited but may be one, or three or more. The kind of information terminal equipment is not limited to the PC 21, nor is it necessary for the PCs 21 to be connected by a wire. That is, the communications network used may transmit and receive information by radio.

As illustrated in FIG. 1A, there are a case where an instruction to perform image formation (print) is given remotely by, for example, transferring data to the image processing apparatus 10 from the PC 21, and a case where the user stands in front of the image processing apparatus 10, and instructs processing such as copying, scan (image reading), and facsimile transmission/reception through various operations.

Figure 2:
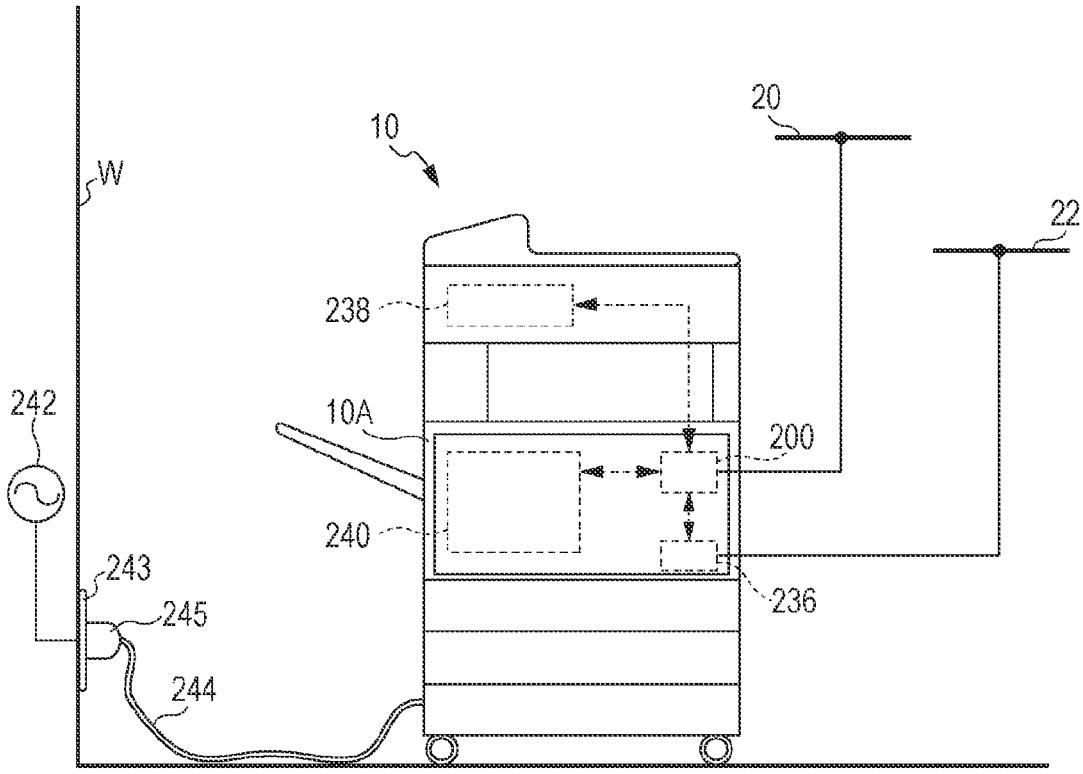
FIG. 2 schematically illustrates the image processing apparatus according to the exemplary embodiment.

FIG. 2 illustrates the image processing apparatus 10 according to the exemplary embodiment.

Roughly speaking, the image processing apparatus 10 includes an image forming section 240 that forms an image on recording paper, an image reading section 238 that reads a document image, and a facsimile communication control circuit 236. The image processing apparatus 100 includes a controller 200. The controller 200 controls the image forming section 240, the image reading section 238, and the facsimile communication control circuit 236 to temporarily store the image data of a document image that has been read, or send out the image data that has been read to the image forming section 240 or the facsimile communication control circuit 236.

The controller 200 is connected with the communications network 20 such as the Internet. The facsimile communication control circuit 236 is connected with a telephone network 22. The controller 200 is, for example, connecting to a host computer via the communications network 20, and has the function of receiving image data, or executing facsimile reception and facsimile transmission using the telephone network 22 via the facsimile communication control circuit 236.

A socket 245 is attached to the end of an input power line 244 to the image processing apparatus 10. As the socket 245 is inserted into a wiring plate 243 of a commercial power supply 242 wired to a wall surface W, the image processing apparatus 10 receives supply of power from the commercial power supply 242.

(Detailed Configuration of Image Processing Apparatus)

Figure 3:
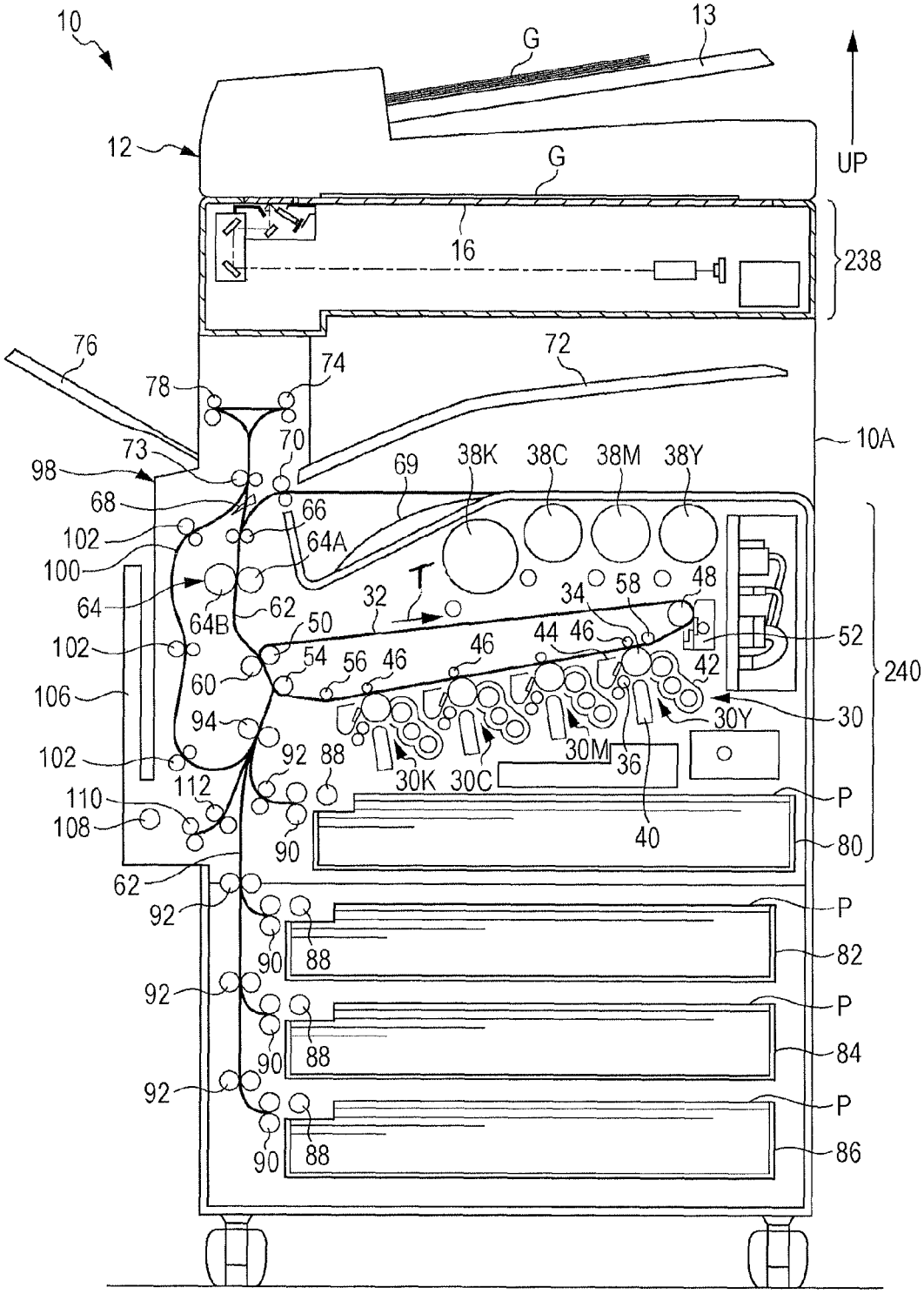
FIG. 3 illustrates the internal configuration of the image processing apparatus according to the exemplary embodiment in detail.

As illustrated in FIG. 3, an automatic document transport device 12, a first platen glass 16, and the image reading section 238 are provided in an upper part of a body 10A of the image processing apparatus 10. The automatic document transport device 12 automatically transports multiple sheets of read document G sheet by sheet. A sheet of read document G is placed on the first platen glass 16. The image reading section 238 reads the read document G transported by the automatic document transport device 12 or the read document G placed on the first platen glass 16. The automatic document transport device 12 includes a document table 13 on top of which multiple sheets of read document G are placed.

The image forming section 240 is provided in the vertically central part of the body 10A. The image forming section 240 includes multiple image forming units 30. The image forming units 30 form toner images of different colors, and are placed in an inclined manner with respect to the horizontal direction. An endless-type intermediate transfer belt 32 is provided above the image forming units 30. As the intermediate transfer belt 32 is driven to circulate in the direction of an arrow A in FIG. 3, toner images of various colors formed in the image forming units 30 are transferred to the intermediate transfer belt 32.

As the image forming units 30, four image forming units 30Y, 30M, 30C, and 30K for yellow (Y), magenta (M), cyan (C), and black (K), respectively, are provided in the stated order.

Each of the four image forming units 30, for example, the image forming unit 30Y basically includes an image holder 34, a charging member 36, an exposing device 40, and a developing unit 42 (the image forming units 30M, 30C, and 30K are of the same configuration, although not designated by corresponding symbols).

Toner cartridges 38Y, 38M, 38C, and 38K are provided over the intermediate transfer belt 32. The toner cartridges 38Y, 38M, 38C, and 38K each supply a predetermined color of toner to the developing unit 42 corresponding to each of the colors yellow (Y), magenta (M), cyan (C), and black (K). Since the toner cartridge 38K is used frequently, the toner cartridge 38K is made larger than the toner cartridges for the other colors.

Also, a first transfer member 46 is provided opposite the image holder 34 across the intermediate transfer belt 32. The first transfer member 46 transfers a toner image formed on the surface of the image holder 34 to the intermediate transfer belt 32. Further, a cleaning device 44 is provided downstream of the first transfer member 46 in the rotation direction of the image holder 34 while in contact with the surface of the image holder 34. The cleaning device 44 cleans residual toner or the like remaining on the surface of the image holder 34 without being transferred from the image holder 34 to the intermediate transfer belt 32.

Light based on image data of each color is sequentially outputted from the exposing device 40 individually provided to each of the image forming units 30Y, 30M, 30C, and 30K. As the surface of the image holder 34 for each color uniformly charged by the charging member 36 is exposed to this light, an electrostatic latent image is formed on the surface of the image holder 34. The electrostatic latent image formed on the surface of the image holder 34 is developed as a toner image in each color by the developing unit 42.

The toner images in the colors yellow (Y), magenta (M), cyan (C), and black (K) sequentially formed on the surface of the image holder 34 are multiple-transferred by the first transfer member 46 onto the intermediate transfer belt 32 that are placed in an inclined manner above the image forming units 30Y, 30M, 30C, and 30K for the corresponding colors.

The intermediate transfer belt 32 is wound around a drive roller 48 for applying a driving force to the intermediate transfer belt 32, a support roller 50 that is driven to rotate, a tension applying roller 54 for applying tension to the intermediate transfer belt 32, a first idler roller 56, and a second idler roller 58.

A cleaning device 52 that cleans the surface of the intermediate transfer belt 32 is provided opposite the drive roller 48 across the intermediate transfer belt 32.

A second transfer member 60 is placed opposite the support roller 50 across the intermediate transfer belt 32. The second transfer member 60 causes the toner image first-transferred onto the intermediate transfer belt 32 to be second-transferred to the recording paper P.

A fixing device 64 is provided above the second transfer member 60. The fixing device 64 fixes a toner image onto the recording paper P to which the toner image has been transferred by the second transfer member 60 and which is transported along a transport path 62. The fixing device 64 includes a heat roller 64A and a pressure roller 64B. The heat roller 64A is placed on the image surface side of the recording paper P. The pressure roller 64B presses the recording paper P toward the heat roller 64A.

On the downstream side of the fixing device 64 in the transport direction of the recording paper P, a transport roller 66 is provided, and then a switching gate 68 is provided next. The switching gate 68 switches the transport direction of the recording paper P.

A first eject roller 70 is provided downstream of the switching gate 68 in the transport direction of the recording paper P. The first ejects roller 70 ejects the recording paper P guided by the switching gate 68 switched to one direction, toward a first eject section 69.

Also, a second eject roller 74 and a third eject roller 78 are provided downstream of the switching gate 68 in the transport direction of the recording paper P. The second eject roller 74 ejects the recording paper P transported by a transport roller 73 while being guided by the switching gate 68 switched to another direction, toward a second eject section 72. The third eject roller 78 ejects the recording paper P toward a third eject section 76.

Also, paper feed sections 80, 82, 84, and 86 each storing recording paper P are provided in a lower part of the body 10A and upstream of the second transfer member 60 in the transport direction of the recording paper P. Sheets of recording paper P of various sizes are stored in the paper feed sections 80, 82, 84, and 86.

Further, the paper feed sections 80, 82, 84, and 86 are each provided with a feed roller 88. The feed roller 88 picks the stored recording paper P out of each of the paper feed sections 80, 82, 84, and 86 and passes the recording paper P to the transport path 62. A transport roller 90 and a transport roller 92 are provided downstream of the feed roller 88 in the transport direction. The transport rollers 90 and 92 transport the recording paper P sheet by sheet.

A registration roller 94 is provided downstream of the transport roller 92 in the transport direction. The registration roller 94 temporarily stops the recording paper P, and delivers the recording paper P to a second transfer position at predetermined timing.

Also, a duplex transport unit 98 is provided to the side of the second transfer position. The duplex transport unit 98 transports the recording paper P while reversing the recording paper P to form an image on both sides of the recording paper P. The duplex transport path 98 is provided with a reversing path 100. The recording paper P transported by reversing the rotation of the transport roller 73 is sent into the reversing path 100. Further, multiple transport rollers 102 are provided along the reversing path 100. The recording paper P transported by the transport rollers 102 is transported to the registration roller 94 again while being reversed upside down.

A folding-type manual paper feed section 106 is provided on the outer side of the apparatus with respect to the duplex transport unit 98. A feed roller 108, and transport rollers 110 and 112 are provided in a lower part of the duplex transport unit 98. The feed roller 108 and the transport rollers 110 and 112 transport the recording paper P fed from the folding-type manual paper feed section 106 that is set in its use position. The recording paper P transported by the transport rollers 110 and 112 is transported to the registration roller 94.

(Control-System Hardware Configuration of Image Processing Apparatus)

Figure 4:
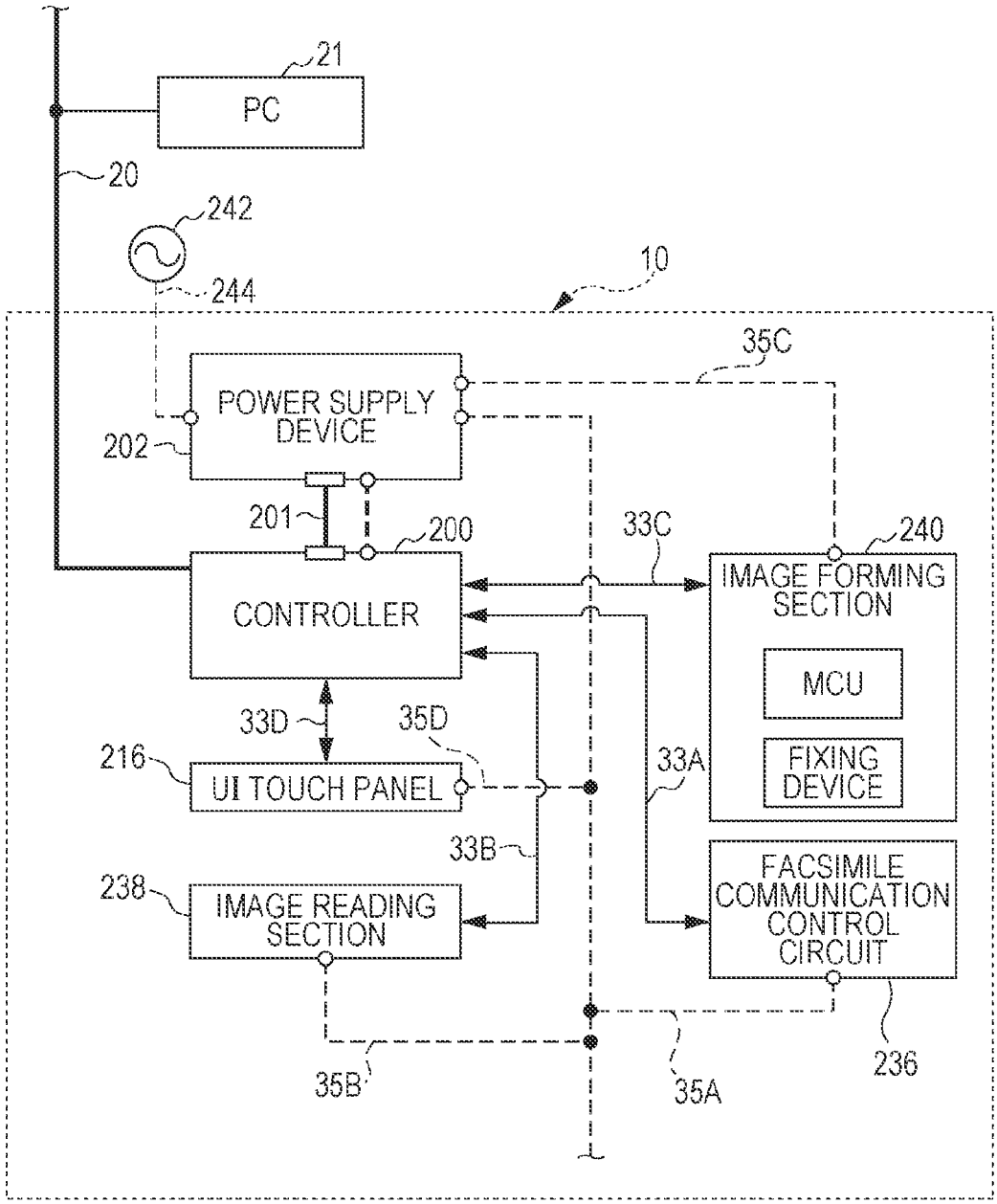
FIG. 4 is a block diagram illustrating the configuration of the control system of the image processing apparatus according to the exemplary embodiment.

FIG. 4 schematically illustrates the hardware configuration of the control system of the image processing apparatus 10.

The communications network 20 is connected to the controller 200. The facsimile communication control circuit 236, the image reading section 238, the image forming section 240, and a UI touch panel 216 are connected to the controller 200 via buses 33A to 33D such as data buses and control buses, respectively. That is, various processing sections of the image processing apparatus 100 are controlled on the basis of the controller 200. A backlight section for the UI touch panel 216 is sometimes attached to the UI touch panel 216.

The image processing apparatus 10 includes a power supply device 202. The power supply device 202 is connected to the controller 200 by a signal harness 201.

The power supply device 202 receives supply of power from the commercial power supply 242.

The power supply device 202 is provided with power supply lines 35A to 35D. The power supply lines 35A to 35D respectively supply power to the controller 200 and the facsimile communication control circuit 236, the image reading section 238, the image forming section 240, and the UI touch panel 216 that are each provided with an independent CPU. The controller 200 is also capable of so-called partial power save control whereby the controller 200 supplies power (power supply mode) or shuts off power (sleep mode) to each processing section (device) individually. The control system including the CPU of the image forming section 240 is sometimes referred to as MCU.

The controller 200 may be provided with a human sensor to monitor the presence of a human in the vicinity of the image processing apparatus 10, and control supply of power accordingly.

Next, the fixing device 64 according to the exemplary embodiment is described. In the exemplary embodiment, the heat resistant temperature and fixing temperature of the fixing device 64 are set as 240° C. and 370° C., respectively.

Figure 5A:
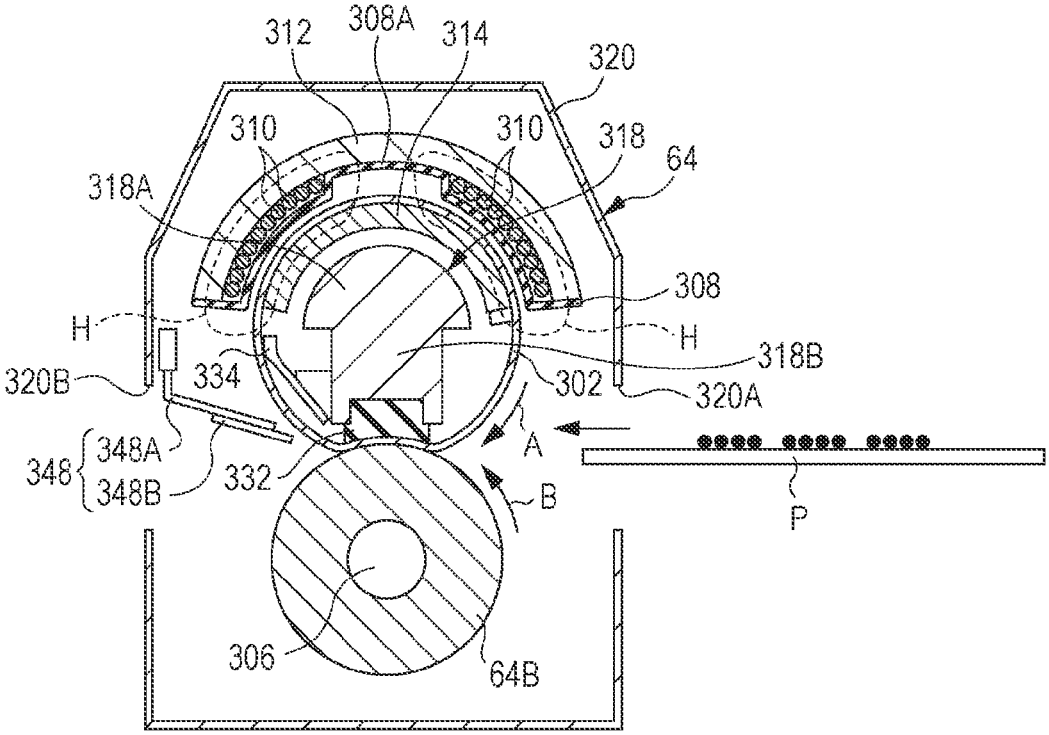
FIGS. 5A and 5B are cross-sectional views of a fixing device according to the exemplary embodiment.
Figure 5B:
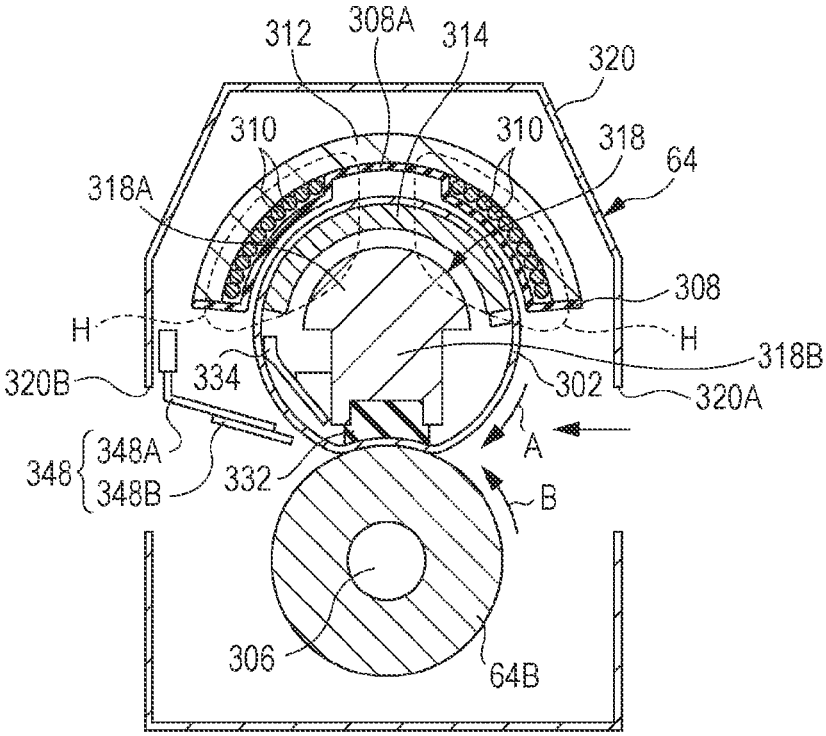

As illustrated in FIG. 5A, the fixing device 64 includes a housing 320 that is provided with openings 320A and 320B to allow entry and exit of the recording paper P. An endless-type fixing belt 302 is provided inside the housing 320. The fixing belt 302 forms the outer periphery of the heat roller 64A. A cylindrical cap member (not illustrated) with a rotating shaft is fitted onto either edge of the fixing belt 302, thereby supporting the fixing belt 302 so as to be rotatable about the rotating shaft. A gear connected to a motor (not illustrated) that rotationally drives the fixing belt 302 is joined to one of the cap members. When the motor activates, the fixing belt 302 rotates in the direction of an arrow A in FIG. 5A.

A bobbin 308 made of an insulating material is placed at a position facing the outer peripheral surface of the fixing belt 302. The bobbin 308 is formed in a substantially arcuate shape conforming to the outer peripheral surface of the fixing belt 302. The bobbin 308 has a projection 308A that projects from substantially the central part of its surface located opposite to the fixing belt 302. The separation between the bobbin 308 and the fixing belt 302 is about 1 mm to 3 mm.

An exciting coil 310 is wound around the bobbin 308 multiple times in the axial direction (depth direction with respect to the plane of FIG. 5A) with the projection 308A as the center. The exciting coil 310 produces a magnetic field H when energized. A magnetic coil 312 is placed at a position facing the exciting coil 310. The magnetic coil 312 is formed in a substantially arcuate shape conforming to the arcuate shape of the bobbin 308. The magnetic coil 312 is supported on the bobbin 308 or the exciting coil 310.

A temperature-sensitive magnetic member 314 having the shape of a substantially arcuate plate is provided inside the fixing belt 302. The temperature-sensitive magnetic member 314 conforms to the shape of the fixing belt 302 and contacts the inner peripheral surface of the fixing belt 302. The temperature-sensitive magnetic member 314 is placed facing the exciting coil 310. Since the temperature-sensitive magnetic member 314 has the function of accumulating heat, the temperature-sensitive magnetic member 314 is also sometimes referred to as "heat accumulating member".

A dielectric 318 made of aluminum is provided inside the temperature-sensitive magnetic member 314. The dielectric 318 may have a thickness not less than the skin depth, and is made of a non-magnetic metal with a small specific resistance. Silver, copper, or aluminum is an exemplary example of such a material. The dielectric 318 includes an arcuate part 318A that faces the inner peripheral surface of the temperature-sensitive magnetic member 314, and a column part 318B formed integrally with the arcuate part 318A. Both ends of the dielectric 318 are secured to the housing 320 of the fixing device 64.

The arcuate part 318A of the dielectric 318 is placed in advance at such a position that when the magnetic flux of the magnetic field H passes through the temperature-sensitive magnetic member 314, the arcuate part 318A guides the magnetic flux of the magnetic field H. The dielectric 318 and the temperature-sensitive magnetic member 114 are separated by 1 mm to 5 mm. As described later, the dielectric 318 and the temperature-sensitive magnetic member 314 are independently supported in place.

A pressing pad 332 is secured and supported onto an end face of the column part 318B of the dielectric 318. The pressing pad 332 presses the fixing belt 302 outwards with a predetermined pressure. This makes it unnecessary to additionally provide a member for supporting each of the dielectric 318 and the pressing pad 332 in place, thus enabling miniaturization of the fixing device 64. The pressing pad 332 is made of a material having elasticity such as urethane rubber or sponge. One end face of the pressing pad 332 contacts the inner peripheral surface of the fixing belt 302 and presses the fixing belt 302.

The pressure roller 64B is held in press contact with the outer peripheral surface of the fixing belt 302. The pressure roller 64B is driven to rotate in the direction of an arrow B in FIG. 5A (direction opposite to the direction of the arrow A in FIG. 5A) as the fixing belt 302 rotates.

The pressure roller 64B is formed by providing a foamed silicon rubber sponge elastic layer with a thickness of 5 mm around a core metal 306 made of aluminum or the like, and further coating the outer side of the foamed silicon rubber sponge elastic layer with a release layer made of a carbon-containing PFA with a thickness of 50 μm. The pressure roller 64B is configured to contact or separate from the outer peripheral surface of the fixing belt 302 by a retract mechanism whereby a bracket (not illustrated) that rotatably supports the pressure roller 64B swings by a cam.

A thermistor 334 is provided inside the fixing belt 302 and in an area not facing the exciting coil 310 and located on the exit side of the recording paper P. The thermistor 334 measures the temperature of the inner peripheral surface of the fixing belt 302. The thermistor 334 measures the surface temperature of the fixing belt 302 by converting the value of resistance that varies with the quantity of heat given from the fixing belt 302 into a temperature. The thermistor 334 contacts substantially the central part along the width direction of the fixing belt 302 so that its measured value does not vary with the size of the recording paper P.

The thermistor 334 is connected to the MCU (see FIG. 4) of the image forming section 240. The MCU measures the temperature of the surface of the fixing belt 302 by performing temperature conversion on the basis of the quantity of electricity sent from the thermistor 334. Then, the MCU compares this measured temperature with a set fixing temperature (e.g. 370° C.) stored in advance, and if the measured temperature is lower than the set fixing temperature, the MCU energizes the exciting coil 310 so as to produce the magnetic field H (see FIG. 5A) as a magnetic circuit. If the measured temperature is higher than the set fixing temperature, the MCU stops the energization.

A peeling member 348 is provided at a position near the contact part (nip part) between the fixing belt 302 and the pressure roller 64B, on the downstream side in the transport direction of the recording paper P. The peeling member 348 includes a support part 348A that is secured in place at one end, and a peeling sheet 348B supported on the support part 348A. The peeling sheet 348B is so placed that its end is in close proximity to or in contact with the fixing belt 302.

Next, a contact and separation mechanism for the temperature-sensitive magnetic member 314 with respect to the fixing belt 302 is described.

As the fixing mode of the fixing device 64, a fixing process performed in a state in which the temperature-sensitive magnetic member 314 is in contact with the fixing belt 302 is defined as "heat accumulation mode", and a fixing process performed in a state in which the temperature-sensitive magnetic member 314 is separated from the fixing belt 302 is defined as "fast heating mode". The specifications of each of these modes are described later.

Figure 6:
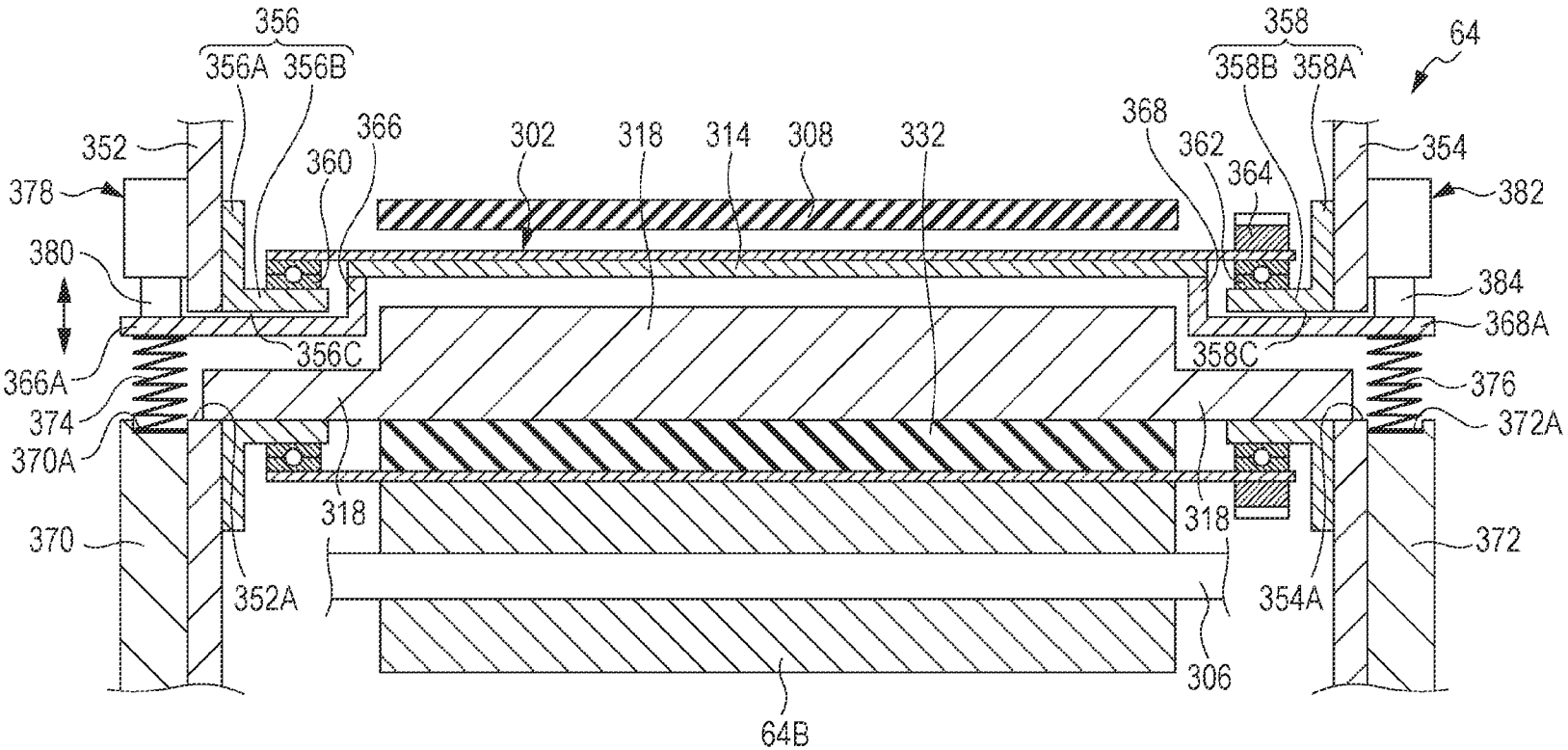
FIG. 6 is a cross-sectional view illustrating the contact and separation mechanism part of the fixing device according to the exemplary embodiment.

As illustrated in FIG. 6, inside the fixing device 64, a pair of side plates 352 and 354 are provided upright so as to sandwich the fixing belt 302 and the pressure roller 64B from both ends. The side plates 352 and 354 respectively have through-holes 352A and 354A each formed at a position facing either end of the fixing belt 302. The through-holes 352A and 354A have a diameter smaller than the inside diameter of the fixing belt 302.

Support members 356 and 358 are provided to the inner walls of the side plates 352 and 354, respectively, with a fastening device (not illustrated) such as a screw. The support member 356 includes a flat plate part 356A, a cylindrical shaft part 356B, and a through-hole 356C. The flat plate part 356A is secured to the side plate 352. The shaft part 356B projects from the flat plate part 356A. The through-hole 356C extends through the flat plate part 356A and the shaft part 356B.

Likewise, the support member 358 includes a flat plate part 358A, a cylindrical shaft part 358B, and a through-hole 358C. The flat plate part 358A is secured to the side plate 354. The shaft part 358B projects from the flat plate part 358A. The through-hole 358C extends through the flat plate part 358A and the shaft part 358B.

The through-holes 352A and 356C are the same in diameter, and communicated with each other in a state in which their inner peripheral walls coincide with each other. Likewise, the through-holes 354A and 358C the same in diameter, and communicated with each other in a state in which their inner peripheral walls coincide with each other.

A bearing 360 and a bearing 362 are inserted and secured onto the shaft part 356B and the shaft part 358B, respectively. The outside diameter of the bearings 360 and 362 is substantially the same as the inside diameter of the fixing belt 302. The inner peripheral surface at either end of the fixing belt 302 is joined and secured to the outer peripheral surface of each of the bearings 360 and 362. The fixing belt 302 is thus rotatable about the center of the shaft parts 356B and 358B as the rotation center.

A gear 364 for rotational drive is attached to the outer peripheral surface at one end of the fixing belt 302. The gear 364 is driven by a motor (not illustrated).

Also, support members 366 and 368 having a substantially L-shaped cross section are each joined at one end to either end of the temperature-sensitive magnetic member 314. Flat plate parts 366A and 368A are formed on the other end side of the support members 366 and 368, respectively. The support members 366 and 368 are made of a material with low heat conductivity so that the heat of the temperature-sensitive magnetic member 314 is not directly transmitted to the support members 366 and 368 as it is.

The flat plate part 366A is inserted through the through-hole 356C and the through-hole 352A, and projects more outwards than the side plate 352. Likewise, the flat plate part 368A is inserted through the through-hole 358C and the through-hole 354A, and projects more outwards than the side plate 354.

A base 370 is provided below the flat plate part 366A. The base 370 has a large width with a recess 370A formed on the top face. The base 370 is secured to the outer wall of the side plate 352. The recess 370A is positioned so as to face the end of the flat plate part 366A of the support member 366.

Likewise, a base 372 is provided below the flat plate part 368A. The base 372 has a large width with a recess 372A formed on the top face. The base 372 is secured to the outer wall of the side plate 354. The recess 372A is positioned so as to face the end of the flat plate part 368A of the support member 368.

One end of a coil spring 374 is secured to the recess 370A, and the other end of the coil spring 374 is secured to the underside of the flat plate part 366A. Likewise, one end of a coil spring 376 is secured to the recess 372A, and the other end of the coil spring 376 is secured to the underside of the flat plate part 368A. Thus, the temperature-sensitive magnetic member 314 is supported in place so as to be movable up and down.

The temperature-sensitive magnetic member 314 comes into contact with the inner peripheral surface of the fixing belt 302 when the coil springs 374 and 376 are in a fully extended state (position). This prevents the fixing belt 302 from being deformed outwards by the temperature-sensitive magnetic member 314.

An electric cylinder 378 is provided at a position above the flat plate part 366A and facing the coil spring 374. The electric cylinder 378 has a cylinder 380 that is projected and retracted from one side. The electric cylinder 378 is secured to the outer wall of the side plate 352 with the cylinder 380 facing downwards.

Likewise, an electric cylinder 382 is provided at a position above the flat plate part 368A and facing the coil spring 376. The electric cylinder 382 has a cylinder 384 that is projected and retracted from one side. The electric cylinder 382 is secured to the outer wall of the side plate 354 with the cylinder 384 facing downwards.

When in its short, retracted state, the end face of the cylinder 380 slightly contacts the top face of the flat plate part 366A. Likewise, when in its short, retracted state, the end face of the cylinder 384 slightly contacts the top face of the flat plate part 368A. The electric cylinders 378 and 382 are both configured to extend and contract the cylinders 380 and 384, respectively, by a solenoid drive, a motor drive, or the like. It is also possible to employ an air cylinder or hydraulic cylinder that extends and contracts each of the cylinders 380 and 384 by opening and closing a solenoid valve by electric control.

Figure 7A:
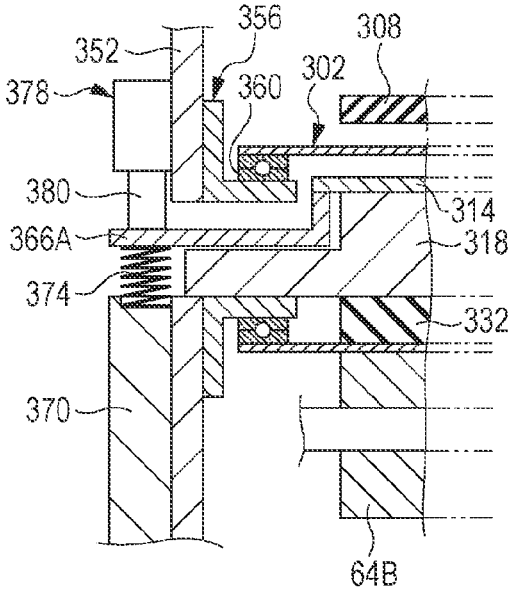

In the exemplary embodiment, when the fixing mode is the "fast heating mode", as illustrated in FIG. 7A, the MCU of the image forming section 240 controls operation of the electric cylinders 378 and 382 so as to extend the cylinders 380 and 384, respectively. Accordingly, as illustrated in FIG. 7B, the temperature-sensitive magnetic member 314 and the fixing belt 302 are held in a separated state.

Figure 7C:
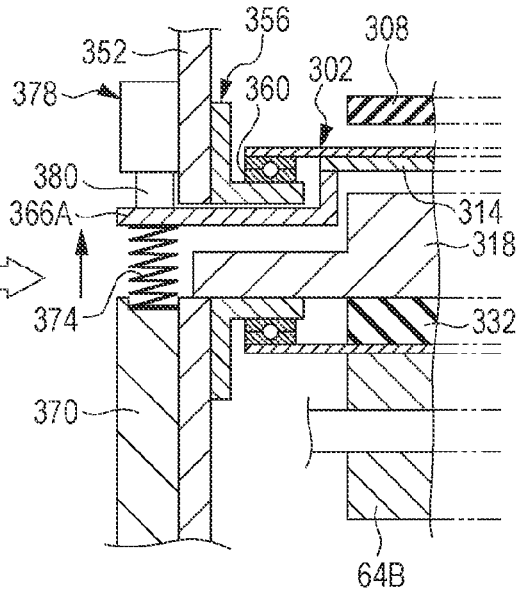
Figure 7B:
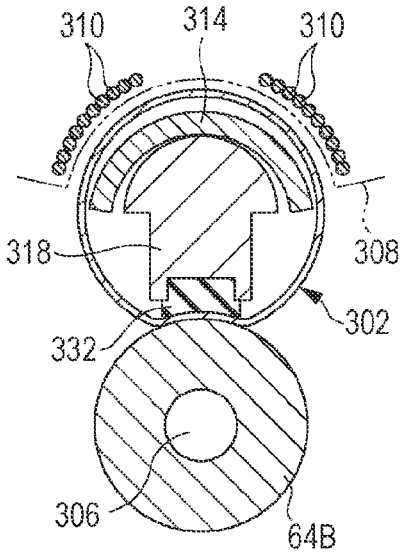
Figure 7D:
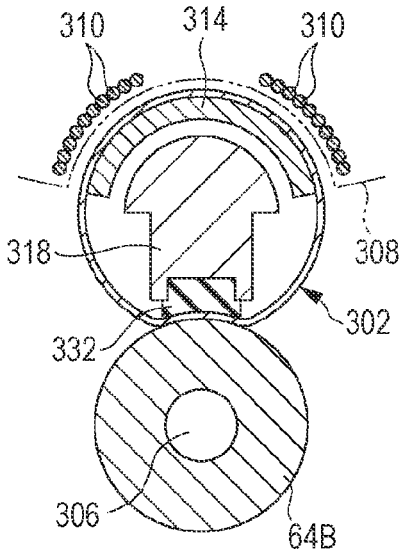

When the fixing mode is the "heat accumulation mode", as illustrated in FIG. 7C, the MCU of the image forming section 240 controls operation of the electric cylinders 378 and 382 so as to contract the cylinders 380 and 384, respectively. Accordingly, as illustrated in FIG. 7D, the temperature-sensitive magnetic member 314 and the fixing belt 302 are held in a contact state.

(Basic Specifications of Fixing Device 64)

The fixing device according to the exemplary embodiment includes the "fast heating mode" and the "heat accumulation mode" as the mode in which to execute a fixing process (fixing mode). Basically, these modes are selectively switched in accordance with the number of sheets to be processed (hereinafter referred to as "the number of processing sheets") in an image forming process.

Table 1 is a cross comparison table between the "fast heating mode" and the "heat accumulation mode". As is apparent from Table 1, a comparison based on total processing time indicates that the "fast heating mode" is suited for small-volume processing in the range of about 1 to several sheets (hereinafter, referred to as "N sheets"), whereas the "heat accumulation mode" is suited for large-volume processing for a number of sheets exceeding N sheets. Although depending on the specifications of the image processing apparatus 10 used, under the specifications illustrated in Table 1, the above-mentioned number of processing sheets N that serves as the borderline to decide which mode to select may be set as N=about 10 sheets.

TABLE 1

| Fixing mode | Relationship between fixing belt and heat accumulating member | FPOT (FCOT) | Throughput | Surplus power |
|---|---|---|---|---|
| Fast heating | Separated (noncontact) | Fast (3-6 sec) | Slow (20-35 ppm) | Yes |
| Heat accumulation | Contact | Slow (13-18 sec) | Fast (40-50 ppm) | No |

The terms "Fast" and "Slow" in Table 1 represent relative relationship between the two modes, and the numerical values in parentheses are an example.

Accordingly, for example, in the case of a copying process, a document image is read by the image reading section 238, and the fixing mode of the fixing device 64 is selected and switched with N sheets set as the borderline number of processing sheets. Of course, the number of processing sheets is determined on the basis of the cumulative value of the number of copies per sheet of document. For example, for five copies of a two-sheet document, the number of processing sheets is 10 sheets.

(Fixing Mode Switching Control)

In cases where processing is performed within the capabilities of the image processing apparatus 10, such as in the case of the copying process mentioned above, the number of processing sheets is known prior to start of an image forming process by the image forming section 240 in most cases. Therefore, the MCU of the image forming section 240 is configured to selectively switch the fixing mode between the "fast heating mode" and the "heat accumulation mode" on the basis of this number of processing sheets.

As the fixing mode, the fast heating mode or the heat accumulation mode is selected depending on whether or not the following operation expression holds:

$$F1+P1\times N<W+F2+P2\times N \quad (1)$$

where

N is the number of processing sheets in image processing,

F1 is the time from instruction of image processing in the fast heating mode until the image processing on the first sheet of recording paper is started (warm-up time), F2 is the time from instruction of image processing in the heat accumulation heating mode until the image processing on the first sheet of recording paper is started (warm-up time), P1 is the image processing time per sheet of recording paper in the fast heating mode, P2 is the image processing time per sheet of recording paper in the heat accumulation mode, and W is the warm-up time for the heat accumulation mode based on an initial value including the temperature of the temperature-sensitive magnetic member 314 (heat accumulating member).

If the expression (1) mentioned above holds, the fast heating mode is selected.

If the expression (1) mentioned above does not hold, the following situations are conceivable.

$$F1+P1\times N>W+F2+P2\times N \quad (2)$$

$$F1+P1\times N=W+F2+P2\times N \quad (3)$$

In the case of the expression (2) above, the heat accumulation mode is selected.

In the case of the expression (3) above, a predetermined mode with the higher priority may be selected. For example, if the fast heating mode has the higher priority, the expression (1) may be transformed as an expression (1)' below:

$$F1+P1\times N\leq W+F2+P2\times N \quad (1)'$$

Figure 8:
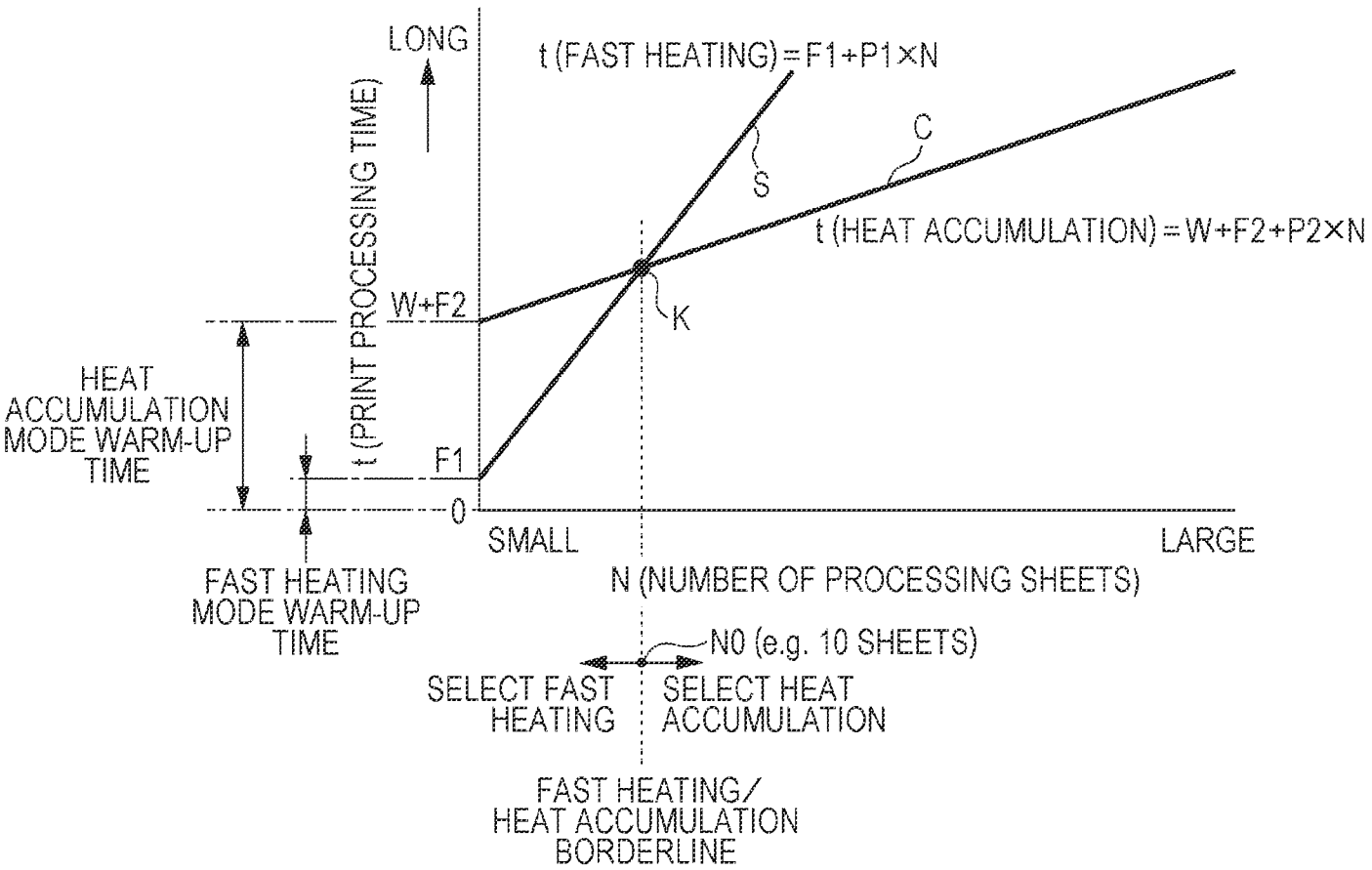
FIG. 8 is a characteristic diagram illustrating the number of processing sheets versus processing time characteristic curves for a fast heating mode and a heat accumulation mode, respectively, according to the exemplary embodiment.

FIG. 8 is a characteristic diagram illustrating correlation between the fast heating mode and the heat accumulation mode, with the number of processing sheets taken along the horizontal axis and time taken along the vertical axis.

As illustrated in FIG. 8, a fast heating mode characteristic curve S maintains a substantially directly proportional characteristic with a gradient that depends on P1, after elapse of the warm-up time (F1) following the instruction of image processing. The expression "substantially directly proportional" means that theoretically, the relationship is directly proportional although the straight line of the curve may sometimes be distorted by error factors such as individual apparatus differences, temperature changes, and transport accuracy.

As illustrated in FIG. 8, a heat accumulation mode characteristic curve C maintains a substantially directly proportional characteristic with a gradient that depends on P2, after elapse of the warm-up time (W+F2) following the instruction of image processing. The expression "substantially directly proportional" means that theoretically, the relationship is directly proportional although the straight line of the curve may sometimes be distorted by error factors such as individual apparatus differences, temperature changes, and transport accuracy.

Since the number of processing sheets is taken along the horizontal axis and time is taken along the vertical axis in FIG. 8, it follows that the greater the relative gradient, the longer the time necessary to execute processing. Accordingly, the gradient of the fast heating mode characteristic curve S is greater than that of the heat accumulation mode characteristic curve C.

Since the respective gradients (P1 and P2) of the two curves differ, the two curves (the fast heating mode characteristic curve S and the heat accumulation mode characteristic curve C) intersect at some point. This intersection (point K in FIG. 8) serves as the borderline (number of processing sheets N0) to decide whether to set the fixing mode to the fast heating mode or the heat accumulation mode. This borderline is, for example, about 10 sheets when conversion is done using the numerical values in Table 1.

In other words, if the number of processing sheets is known, on the basis of the expression (1)' mentioned above, the fast heating mode is selected up to 10 sheets, and the heat accumulation mode is selected for 11 or more sheets.

Operation of the exemplary embodiment is described below.

FIG. 9 is a control flow chart based on the steps until the fixing mode of the fixing device 64 is determined in the control of image processing by the image processing apparatus 10.

In step S400, it is determined whether or not image processing has been instructed. If the determination result is negative, this routine ends.

If the determination result in step S400 is positive, the processing transfers to step S402, in which each of the operation expression parameters F1, F2, P1, P2, and W are extracted. These parameters include fixed numerical values (constants) and values that vary with environment (variables). These parameters may be extracted every time image processing is instructed, for example.

For example, the parameter W is the warm-up time that varies with the initial temperature of the temperature-sensitive magnetic member 314 or the like. Accordingly, the timing of extracting this parameter may sometimes vary with the presence/absence of residual heat from the previous image processing, or with variation of initial temperature due to environmental temperature.

The parameters F1 and F2 each represent FCOT that is determined by the temperature of the fixing device 64 at the start of processing. Since an allowable range of temperature exists for the fixing temperature, the FCOT may sometimes differ for the upper limit and lower limit of the temperature range.

The parameters P1 and P2 are each dependent on the transport capability of the apparatus and therefore a fixed value theoretically. However, this value may sometimes vary if there is a change in stand-by time or the like due to a factor such as a change in the control program of the transport system.

In the next step S404, it is determined whether or not the number of processing sheets N is known. If the determination result in step S404 is positive, the processing transfers to step S406, and the number of processing sheets N is acquired. Then, the processing proceeds to step S408, in which the operation expression (1)' below is read, and the processing then transfers to step S410.

$$F1+P1\times N\leq W+F2+P2\times N \quad (1)'$$

In step S410, the parameters extracted in step S402 mentioned above, and the number of processing sheets N are substituted into the operation expression (1)', and it is determined whether or not the operation expression (1)' holds. The processing then proceeds to step S412.

In step S412, the results of determination are discriminated. If it is determined that the operation expression (1)' holds in step S412, the processing proceeds to step S414, in which switching to the fast heating mode is executed, and then the processing proceeds to step S418. If it is determined that the operation expression (1)' does not hold in step S412, the processing proceeds to step S416, in which switching to the heat accumulation mode is executed, and then the processing proceeds to step S418.

In the next step S418, image processing is executed, and this routine ends.

The switching of the fixing mode in each of steps S414 and S416 is executed as follows.

In a case where the fixing mode is the "fast heating mode", as illustrated in FIG. 7A, the MCU of the image forming section 240 controls the operation of the electric cylinders 378 and 382 so as to extend the cylinders 380 and 384, respectively. Accordingly, as illustrated in FIG. 7B, the temperature-sensitive magnetic member 314 and the fixing belt 302 are held in a separated state.

In a case where the fixing mode is the "heat accumulation mode", the MCU of the image forming section 240 controls the operation of the electric cylinders 378 and 382 so as to contract the cylinders 380 and 384, respectively. Accordingly, as illustrated in FIG. 7D, the temperature-sensitive magnetic member 314 and the fixing belt 302 are held in a contact state.

If the determination result in step S404 mentioned above is negative, that is, if it is determined that the number of processing sheets N is not known, the processing proceeds to step S420. In step S420, notification of an instruction to input is executed. For example, the borderline N0 is displayed on the UI touch panel 216, and information for urging the user to input whether or not the number of processing sheets is less than or equal to N0 is displayed.

As an example of the information to be displayed, a message such as "Check the number of processing sheets. N0 sheets or less?→"0"; more than N0 sheets?→"1"" is displayed. The number of sheets may be directly displayed as well.

If the kind of image processing desired by the user is copying from a document, the number of processing sheets N equals this document times the number of copies. At this time, the user sometimes knows the number of sheets in the document.

Accordingly, when displaying the borderline N0 on the UI touch panel 216, a value equal to N0 divided by the number of copies $N_C$ (hereinafter, referred to as $N0/N_C$="N1") may be displayed. The message in this case may be "Check the number of document sheets. N1 sheets or less?→"0"; more than N1 sheets?→"1"". In the exemplary embodiment, "N0" means "N0 (or N1)".

In the next step S422, it is determined whether or not an input has been made in response to the notification of an instruction to input. If the determination result in this step S422 is negative, the processing proceeds to step S424. In step S424, it is determined whether or not a preset period of time has elapsed, and if the determination result is negative, the processing returns to step S422.

If the determination result in step S422 is positive, it is determined that there has been a reply to the notification of an instruction to input, and the processing proceeds to step S426. In step S426, an inputted numerical value of "0" indicating N0 or less is regarded as indicating that the condition "holds", and an inputted numerical value of "1" indicating more than N0 is regarded as indicating that the condition "does not hold", and then the processing proceeds to step S412 mentioned above.

If the determination result in step S424 is positive, it is determined that there has been no reply to the notification of an instruction to input, and the processing proceeds to step S428. In step S428, it is discriminated which one of the modes is the preset fixing mode (default). The default fixing mode is determined in accordance with the processing environment of each individual user. For example, the default fixing mode may be set as the fast heating mode if the processing volume in a single job is small, and may be set as the heat accumulation mode if the processing volume in a single job is large or if small-volume processing is to be executed continuously.

If the preset fixing mode is determined to be the fast heating mode as a result of the discrimination in this step S428, the processing proceeds to step S414. If the preset fixing mode is determined to be the heat accumulation mode in step S428, the processing proceeds to step S416.

In the exemplary embodiment, when setting the number of processing sheets N0 serving as the borderline illustrated in FIG. 8, the number of processing sheets N0 is determined simply on the basis of the number of sheets, with no particular regard to the form of image processing performed. However, in the fixing process using the fixing device 64, the quantity of heat transmitted to (taken by) the recording paper varies with the form of image processing, including the kind of the recording paper (thickness, material, etc.), whether the image is in black and white or color, image density, and whether the image is a text or picture image.

Accordingly, the borderline number of processing sheets N0 may be set in accordance with the form of standard image processing (plain paper, black-and-white image, text image, and medium-level resolution), and then the borderline number of processing sheets N0 may be corrected in accordance with the form of each individual image processing. For example, if a recording paper thicker than the plain paper is used, or if a color image is designated, the borderline N0 is corrected to a smaller value. If low-resolution is designated as in the case of high-speed processing or the like, the borderline N0 is corrected to a greater value.

(Modifications)

Figure 10A:
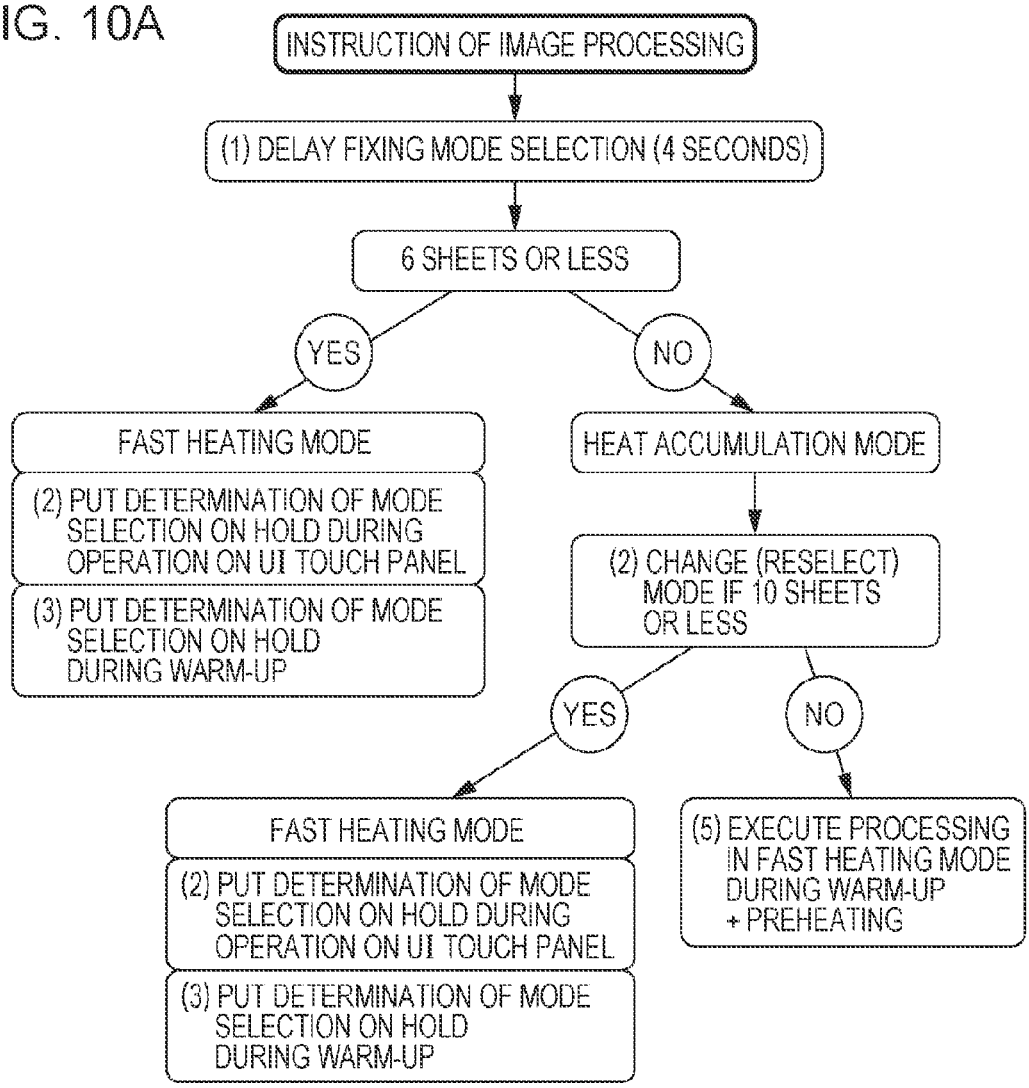
FIGS. 10A and 10B are transition diagrams according to Modifications 1 to 5 with respect to selection of the fixing mode after image processing is instructed and after image processing is started, respectively.
Figure 10B:
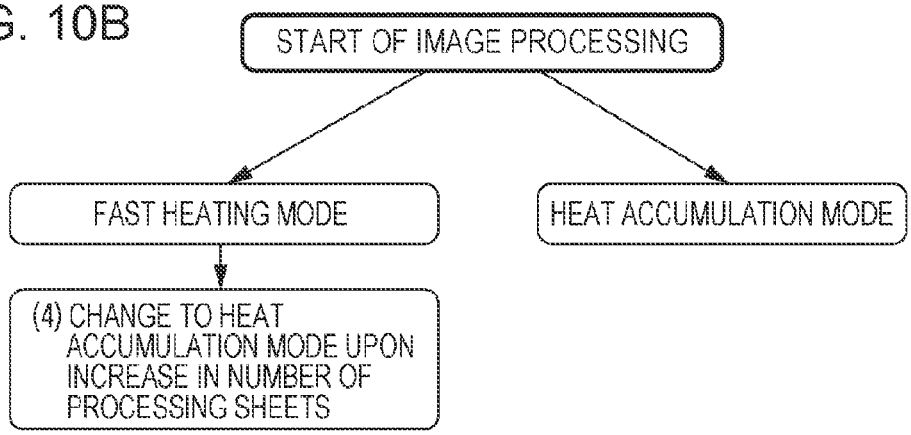

In the exemplary embodiment mentioned above, the control is based on selection of the fixing mode in a case where the number of processing sheets N is known, and in a case where the number of processing sheets N is unknown, the user is urged to make an input. Hereinbelow, modifications for the case where the number of processing sheets N is unknown are described. FIGS. 10A and 10B are transition diagrams according to Modifications 1 to 5 with respect to selection of the fixing mode after image processing is instructed and after image processing is started, respectively.

As illustrated in (1) in FIG. 10A, in Modification 1, a delay time is provided after instruction of image processing.

Statistically speaking, in image processing, the number of document sheets to be processed in a single job for general office work is typically about "1 to 6 sheets/one copy". In Modification 1, a delay time corresponding to the time necessary for reading such a document is provided.

If the number of document sheets that have been read is 6 sheets (or if the number of processing sheets N based on the total cumulative number of copies is 6) or less at the point in time when the delay time elapses, the fast heating mode is selected, and otherwise the heat accumulation mode is selected.

That is, as first control, by setting a delay time for the selection timing of the fixing mode, the number of sheets frequently handled in image processing is determined so that the convenience of the fast heating mode is fully exploited.

As illustrated in (2) in FIG. 10A, in Modification 2, a case is considered where the heat accumulation mode has been selected as the fixing mode in Modification 1 mentioned above, with the number of sheets read already exceeding 6 sheets in the first control, but it turns out that the actual number of processing sheets is less than or equal to the borderline N0 (the relational expression (1)' is satisfied). In this case, the fixing mode is changed from the heat accumulation mode to the fast heating mode. Although contrary to the heating of the temperature-sensitive magnetic member 314 already performed in the heat accumulation mode or energy saving, such a mode change leads to reduced processing time by giving priority to convenience.

At this time, there is a possibility that the number of processing sheets may increase while the user is operating on the UI touch panel 216. Accordingly, for example, the change to the fast heating mode may be put on hold until the operation on the UI touch panel 216 ends.

As illustrated in (3) in FIG. 10A, in Modification 3, if the number of processing sheets increases or if the next job is accepted successively during warm-up (the warm-up time for the fast heating mode is 4 seconds or less) following selection of the fast heating mode after the discrimination using the operation expression (1)', the operation expression (1)' may sometimes cease to hold at that point.

Accordingly, until the warm-up for the fast heating mode completes, a change (increase) in the number of processing sheets is monitored, and at the point when the operation expression (1)' ceases to hold, the fixing mode is changed from the fast heating mode to the heat accumulation mode. Until image processing in the fast heating mode begins, executing processing by switching the fixing mode again leads to a reduction in the time taken until the end of processing.

As illustrated in (4) in FIG. 10B, in Modification 4, if the number of processing sheets increases or if the next job is accepted successively after processing is started in the fast heating mode selected following the discrimination using the operation expression (1)', the operation expression (1)' may sometimes cease to hold at that point.

Accordingly, while image processing is executed in the fast heating mode, a change (increase) in the number of processing sheets is monitored. If the operation expression (1)' ceases to hold, the fixing mode is changed from the fast heating mode to the heat accumulation mode in accordance with the relationship between the time required until the end of processing when image processing is continuously executed in the fast heating mode, and the time required until the end of processing when image processing is executed by switching the fixing mode again. The "relationship between the time required until the end of processing when image processing is continuously executed in the fast heating mode, and the time required until the end of processing when image processing is executed by switching the fixing mode again" means that because the remaining number of processing sheets, changing of the fixing mode during image processing, and the transport system for the recording paper P (temporary stop or the like) may be also affected, whether or not to change the fixing mode is to be determined by taking various factors into consideration.

As illustrated in (5) in FIG. 10A, while the temperature-sensitive member 314 is heated by the bobbin 318 (IH heating with the exciting coil 310 that produces the magnetic field H when energized), in Modification 5, a pre-heating section is provided separately. This pre-heating section may be in the same form of IH heating as the bobbin 308 or another form of heating such as a halogen lamp.

For example, in a case where the heat accumulation mode is selected as the fixing mode, during warm-up for the heat accumulation mode, the pre-heating section is used to aid in the heating of the temperature-sensitive magnetic member 314. As a result, it is possible to make effective use of the warm-up time for the heat accumulation mode, and further, the warm-up time is shortened for improved convenience.

The pre-heating section may be provided only in cases where an optional device such as a finisher is not used and there is so-called surplus electric power in the image processing apparatus 10.

The exemplary embodiment and Modifications 1 to 5 are implemented on the basis of (a) to (k) below.

(a) Control a determination of fast heating/heat accumulation as fixing mode based on parameters.

(b) Determine the mode on the basis of operation expressions.

(c) Request the user to input a value N.

(d) Request the user to input a value $N/N_C$ that takes the number of copies into account.

(e) Determine whether or not the number of sheets is a small-volume processing sheet count (1 to 6 sheets) that is frequently processed, with 10 sheets as the borderline.

(f) Start processing in the heat accumulation mode in a case where the number of sheets is a small-volume processing sheet count (1 to 6 sheets) that is frequently processed, and change the mode to heat accumulation once the number of processing sheets is determined to be less than a value N0.

(g) Change the mode to heat accumulation when the number of processing sheets increases during warm-up in the fast heating mode.

(h) Change the mode to heat accumulation when the number of processing sheets increases during image processing in the fast heating mode.

(i) Even when the heat accumulation mode is selected, during warm-up, pre-heat the heat accumulating member with surplus electric power while starting processing in the fast heating mode.

(j) Start processing in the heat accumulation mode in a case where the number of sheets is greater than a small-volume processing sheet count (1 to 6 sheets) that is frequently processed, and once the number of processing sheets is determined to be less than the value N0, change the mode to fast heating, and also put the mode change to fast heating on hold while a job is being accepted.

(k) Correct the number of processing sheets N in accordance with the form of image processing.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image processing apparatus comprising:

an image forming section;

a fixing section that fixes a developer onto a recording paper by applying at least heat treatment, after a developing process using the developer is performed on the recording paper, the fixing section including a fixing member that contacts the recording paper, and a heat accumulating member;

a mode switching section that functions as a part of the image forming section, and selectively switches a fixing mode that heats the fixing member in advance, the fixing mode including a fast heating mode that relatively focuses on rapid raising of a temperature, and a heat accumulation mode that relatively focuses on heat accumulation in the heat accumulating member in advance for high productivity;

a selecting section that selects one of the fast heating mode and the heat accumulation mode as the fixing mode on a basis of a relationship between operation expressions $F1+P1\times N$ and $W+F2+P2\times N$, where N is a number of processing sheets that is a number of sheets to be processed in image processing, F1 is a time from instruction of the image processing in the fast heating mode until the image processing on a first sheet of the recording paper is started, P1 is an image processing time per sheet of the recording paper in the fast heating mode, W is a warm-up time for the heat accumulation mode based on an initial value including a temperature of the heat accumulating member, F2 is a time from instruction of the image processing in the heat accumulation mode until the image processing on the first sheet of the recording paper is started, and P2 is an image processing time per sheet of the recording paper in the heat accumulation mode; and a switching controller that controls the mode switching section to switch to one of the fast heating mode and the heat accumulation mode on a basis of the fixing mode selected by the selecting section.

2. The image processing apparatus according to claim 1, wherein:

the selecting section selects the fast heating mode in a case where the operation expressions have a relationship $F1+P1\times N<W+F2+P2\times N$;

the selecting section selects the heat accumulation mode in a case where the operation expressions have a relationship $F1+P1\times N>W+F2+P2\times N$; and the selecting section selects a predetermined one of the fast heating mode and the heat accumulation mode that has a higher priority, in a case of a number of processing sheets N0 that makes a relationship $F1+P1\times N=W+F2+P2\times N$ hold between the operation expressions.

3. The image processing apparatus according to claim 2, further comprising:

a delay section that delays the selecting by the selecting section until a number of sheets N0-A smaller than the number of processing sheets N0 by a plurality number of sheets or more is counted, in a case where the number of processing sheets N in the image processing is undetermined when the image processing is instructed.

4. The image processing apparatus according to claim 2, further comprising:

a delay section that delays the selecting by the selecting section until a number of sheets N0-A smaller than the number of processing sheets N0 by a plurality number of sheets or more is counted, in a case where the number of processing sheets N in the image processing is undetermined when the image processing is instructed, wherein the selecting section selects the heat accumulation mode at a time when the number of sheets N0-A is exceeded, and the fixing mode is changed to the fast heating mode in a case where the relationship $F1+P1\times N<W+F2+P2\times N$ holds with the number of processing sheets N that has been determined.

5. The image processing apparatus according to claim 2, wherein the fixing mode is changed to the heat accumulation mode in a case where, during warm-up in the fast heating mode after the relationship $F1+P1\times N<W+F2+P2\times N$ holds as a result of comparison of the operation expressions and the fast heating mode is selected as the fixing mode, the number of processing sheets N increases so that the relationship $F1+P1\times N>W+F2+P2\times N$ holds.

6. The image processing apparatus according to claim 2, wherein the fixing mode is changed to the heat accumulation mode in a case where, during the image processing in the fast heating mode after the relationship $F1+P1\times N<W+F2+P2\times N$ holds as a result of comparison of the operation expressions and the fast heating mode is selected as the fixing mode, the number of processing sheets N increases so that the relationship $F1+P1\times N>W+F2+P2\times N$ holds.

7. The image processing apparatus according to claim 2, further comprising:

a delay section that delays the selecting by the selecting section until a number of sheets N0-A smaller than the number of processing sheets N0 by a plurality number of sheets or more is counted, in a case where the number of processing sheets N in the image processing is undetermined when the image processing is instructed, wherein the selecting section selects the heat accumulation mode at a time when the number of sheets N0-A is exceeded, the fixing mode is changed to the fast heating mode in a case where the relationship $F1+P1\times N<W+F2+P2\times N$ holds with the number of processing sheets N that has been determined, and the changing to the fast heating mode is put on hold while a next image processing instruction is accepted.

8. The image processing apparatus according to claim 1, further comprising:

an input and output device that inputs and outputs information interactively with a user, and an output controller that outputs a value N0 that makes an equation hold between the operation expressions to the input and output device, and urges the user to input a result of comparison between the value N0 outputted to the input and output device and a number of sheets in a document, from the input and output device as selection result information of the selecting section, in a case where the number of processing sheets N in the image processing is undetermined when the user prepares the document and instructs the image processing.

9. The image processing apparatus according to claim 1, further comprising:

an input and output device that inputs and outputs information interactively with a user, an output controller that outputs a value N0/B obtained by dividing a value N0 that makes an equation hold between the operation expressions by a number of copies B to the input and output device, and urges the user to input a result of comparison between the value N0/B outputted to the input and output device and a number of sheets in a document, from the input and output device as selection result information of the selecting section, in a case where the number of processing sheets N in the image processing is undetermined when the user prepares the document and instructs the image processing by specifying the number of copies B.

10. The image processing apparatus according to claim 1, further comprising:

a pre-heating section that pre-heats the heat accumulating member, wherein during warm-up after the heat accumulation mode is selected as the fixing mode by the selecting section, the heat accumulating member is pre-heated by the pre-heating section while executing the image processing by switching the fixing mode to the fast heating mode.

11. The image processing apparatus according to claim 1, wherein the number of processing sheets N applied to the operation expressions is corrected on a basis of information on a form of image processing including at least one of a kind of the recording paper, whether an image is a text or picture image, whether the image is in black and white or color, and an average image density.

12. An image processing apparatus comprising:

an image forming section;

a fixing section that fixes a developer onto a recording paper by applying at least heat treatment, the fixing section including a fixing member that contacts the recording paper, and a heat accumulating member;

a mode switching section that selectively switches a fixing mode that heats the fixing member in advance, the fixing mode including a heat accumulation mode and a fast heating mode, the heat accumulation mode being that a temperature of the heat accumulating member and the fixing member are raised in a state that the heat accumulating member contacts the fixing member, and the fast heating mode being that a temperature of the fixing member is raised more quickly than in a case of the heat accumulation mode, in a state that the heat accumulating member is apart the fixing member;

a selecting section that selects one of the fast heating mode and the heat accumulation mode as the fixing mode on a basis of a relationship between operation expressions $F1+P1\times N$ and $W+F2+P2\times N$, where N is a number of processing sheets that is a number of sheets to be processed in image processing, F1 is a time from instruction of the image processing in the fast heating mode until the image processing on a first sheet of the recording paper is started, P1 is an image processing time per sheet of the recording paper in the fast heating mode, W is a warm-up time for the heat accumulation mode based on an initial value including the temperature of the heat accumulating member, F2 is a time from instruction of the image processing in the heat accumulation mode until the image processing on the first sheet of the recording paper is started, and P2 is an image processing time per sheet of the recording paper in the heat accumulation mode; and a switching controller that controls the mode switching section to switch to one of the fast heating mode and the heat accumulation mode on a basis of the fixing mode selected by the selecting section.

13. The image processing apparatus according to claim 12, wherein:

the selecting section selects the fast heating mode in a case where the operation expressions have a relationship $F1+P1\times N<W+F2+P2\times N$;

the selecting section selects the heat accumulation mode in a case where the operation expressions have a relationship $F1+P1\times N>W+F2+P2\times N$; and the selecting section selects a predetermined one of the fast heating mode and the heat accumulation mode that has a higher priority, in a case of a number of processing sheets N0 that makes a relationship $F1+P1\times N=W+F2+P2\times N$ hold between the operation expressions.

* * * * *